US005325102A

United States Patent [19]

Page

[11] Patent Number: 5,325,102

[45] Date of Patent: Jun. 28, 1994

[54] RECEIVER SYSTEM EMPLOYING AN OPTICAL COMMUTATOR

[75] Inventor: Derrick J. Page, Crownsville, Md.

[73] Assignee: Westinghouse Electric Corporation, Pittsburgh, Pa.

[21] Appl. No.: 73,903

[22] Filed: Jun. 4, 1993

[51] Int. Cl.[5] ..... H01Q 3/22

[52] U.S. Cl. ..... 342/375

[58] Field of Search ..... 342/375, 374, 154, 372; 250/553, 227.26, 227.12

[56] References Cited

U.S. PATENT DOCUMENTS 4,492,427 1/1985 Lewis et al. ..... 350/96.20

4,620,193 10/1986 Heeks .

4,814,773 3/1989 Wechsberg et al. .

*Primary Examiner*—Theodore M. Blum

[57] ABSTRACT

A device for delaying signals received from elements of an array antenna by providing delay paths of selectable lengths between respective antenna elements and signal processing means. A plurality of first optical fibers are provided, each having a selected length. A plurality of second optical fibers having selected lengths are also provided. The first fibers are alignable with the second fibers to form respective delay paths. At least one of the set of first fibers and set of second fibers is moveable relative to the other so that when moved, selected first fibers are aligned with selected second fibers creating a delay path of a selected length from each antenna element to the signal processing means.

20 Claims, 7 Drawing Sheets

RECEIVER SYSTEM EMPLOYING AN OPTICAL COMMUTATOR

BACKGROUND OF THE INVENTION

1. Field of the Invention

This invention relates to array antennas and is particularly concerned with providing time delay steering to array antenna elements.

2. Description of the Prior Art

The antenna in radar systems and in many communications systems must face the microwave source to achieve the necessary signal to noise ratio, or to provide directional information. A parabolic dish with a receiver element at the focus is convenient to use for steering an antenna in a fixed direction. Moving dishes can be employed for moving sources or for radar systems, but moving dishes do not have the ability to change directions rapidly. Phased arrays may be used to rapidly change direction, however, such arrays are very complex and tend to be expensive. Furthermore, because the steering is determined by the element's spacing along the array, the relative phase shift imposed in the element signal and the frequency, phased arrays may only operate over a very limited bandwidth.

An array antenna consists of a group of antenna elements spaced apart usually at regular intervals to form an array. By either controlling the relative timing or the phasing of the common signal at the receiving elements, the antenna may be steered towards the microwave source.

The most common means of 'steering an antenna array is to control the relative phase of the signal at the elements. For the case of a flat antenna array, if a beam is pointed toward the array in the boresight direction, which is the direction perpendicular to the plane of the array all the elements will receive the signal in unison. If the beam is pointed (received) at some angle from the boresight direction, the signal is received along the face of the array with a linearly increasing phase shift. Each element is equipped with a phase shifter so that when a signal is received with an increasing phase shift, the phase at each element may be reconciled so that the total signal from each of the elements is in phase. The phase shifters may be "steered" so that a signal that arrives from a selected direction will be in phase.

Controlling the relative phase of each of the antenna elements requires that each element contain a phase shifting device and that an electronic control system be used to control the phase of each of the elements. However, the wide scale use of phased arrays has been limited by the high cost of their complex circuitry. Furthermore, if the phase shifting circuit is adjusted to steer the antenna in a particular direction, this setting will only be valid for a particular frequency. Therefore, known phase shifting techniques impose a limit on the frequency range of operation.

The use of fiber optics in communication systems is known. The optical fiber is usually used to connect two distant points so that communications can be conducted. For the conveyance of signals, commercially available laser unit is used to generate an optical signal. The optical signal travels through the optical fiber to where it is converted to a microwave signal by an optical detector and a microwave amplifier, which are commercially available. Fiber optic media offer the advantage of exceptional bandwidth as compared with other traditional transmission means such as copper wire.

Optical techniques have been suggested to control array elements. Schemes have been proposed to use a selection of optical fibers with lengths arranged in a binary or quadratic sequence and to switch in a series string combination to achieve a desired timing. This would result in a very complex control scheme employing thousands of optical fibers and optical switches for even the simplest phased array.

SUMMARY OF THE INVENTION

I provide a device that performs the timing function for an antenna array. The timing scheme for a particular array antenna design is "hard-wired" by having a series of optical fiber delay lines built-in to a movable element which are alignable with a series of input optical fibers. The input fibers are of selected lengths and have first ends which are connected to respective antenna elements by electrical signal to optical signal conversion means. The optical fiber delay lines of the movable element are also of selected lengths and a first end of the movable fibers are alignable to respective input fibers. The movable element fibers transfer the optical signals to means for converting the optical signals to an RF signal. The RF signal is then processed by conventional means.

The movable element may be any element that moves relative to the input fibers such as a carriage that moves linearly relative to the input fibers, but the preferred moving element is a cylindrical rotor which may be rotated. As the rotor rotates, the optical signals representing RF signals received at the antenna elements are transmitted through selected optical delay line paths to means for converting the optical signals to an RF signal. The delay line paths compensate for any time delay of the signals at the antenna elements. By controlling the amount of time delay at each antenna element, the individual signals received at the antenna elements may be brought into exact time coincidence at the optical commutator output where the coincident signals are processed in conventional fashion.

In a first preferred embodiment, the hard-wired optical delay lines are built into a device that resembles an electric motor. In this embodiment, a rotor is provided having an inner cylindrical surface and a coaxial outer cylindrical surface. The rotor inner surface borders and defines a cylindrical cavity. The optical fibers are disposed within the rotor and each have a first end that terminates along the periphery of the rotor outer surface. The rotor optical fibers further have a second end that terminates at the center of the rotor cavity. The rotor fiber first ends are circumferentially spaced on the outer surface periphery.

A stator is also provided. The stator has a cylindrical cavity disposed therethrough defined by a cylindrical surface of the stator that borders the stator cavity. The rotor is disposed coaxially within the stator cavity. A plurality of input optical fibers are disposed within the stator. A first end of the input optical fibers are connectable by way of electrical to optical signal conversion means to respective antenna elements. Thus, the RF signals received at the antenna elements are introduced into the first end of the input fibers as an optical signal. A second end of each input optical fiber is alignable with the first end of the selected rotor fibers. An aligned rotor fiber and input fiber comprises a single delay path for a signal received at an antenna element to follow.

Being configured as a rotor and a stator, the device may also operate as a conventional electric motor by providing a set of integrated electrical windings. Alternatively, the rotor may be mounted on a shaft or otherwise caused to rotate through an independent motor. The optical detector will be positioned so as to receive the optical signals from the center of the rotor cavity, receiving the optical signal from the rotor fiber second ends. The electrical to optical signal conversion means is preferably low noise amplifiers in series with laser diodes.

A second preferred embodiment also involves a generally cylindrical rotor as the movable element. A plurality of optical fibers are provided within the rotor, with both the first and second ends of the fibers terminating along the periphery of the rotor such that the fiber ends are circumferentially spaced on the rotor periphery. As with the embodiment above, the optical fibers in the rotor each have selected lengths. A plurality of input optical fibers, each of a selected length, are also provided. A first end of the input fibers are connectable to respective antenna elements. A second end of each input fiber is alignable with the first end of the selected rotor fibers. An aligned input fiber and rotor fiber comprise a respective delay path from an antenna element. An optical detector located at the outer periphery of the rotor converts and combines the optical signals to an RF signal. A set of optical fibers may be provided intermediate to the rotor fibers and the optical detector.

The input fiber optics may be placed in a housing that is independent from the optical detector. Alternatively, both the optical detector and the input optical fibers may be housed in a stator that is coaxial to and surrounds the rotor. In any event, a means is provided for rotating the rotor. The rotor can be rotated so that different combinations of rotor fibers can be aligned with the input fibers, creating different sets of delay paths from the antenna elements. The delay paths may also comprise respective intermediate optical fibers.

By placing the signals received at each element through paths that are selectable in length, the time in which it takes the signals to arrive at some signal processing means may be controlled. With the timing at each element controllable, the antenna array may be steered in a direction that will maximize signal reception.

Two dimensional antenna steering can be accomplished by employing two optical commutators in series, one optical commutator provides the elevation and the other the bearing steering. The first commutator provides a selected number of inputs which feed a second commutator in which each of the signals exiting the first commutator are in turn divided into a selected number of inputs to the second commutator so as to provide the delays necessary to steer a full planar array.

The optical commutator may be employed in a number of antenna array configurations. For example, the antenna elements may be arranged in a linear array, in a circular array or in a conformal array. Additionally, it may be useful to employ more than one set of rotor fibers so that different groupings of antenna elements are connectable to different time delay paths.

Other objects and advantages of the invention will become apparent from a description of certain present preferred embodiments thereof shown in the drawings.

DETAILED DESCRIPTION OF THE PREFERRED EMBODIMENT

Figure 1A:
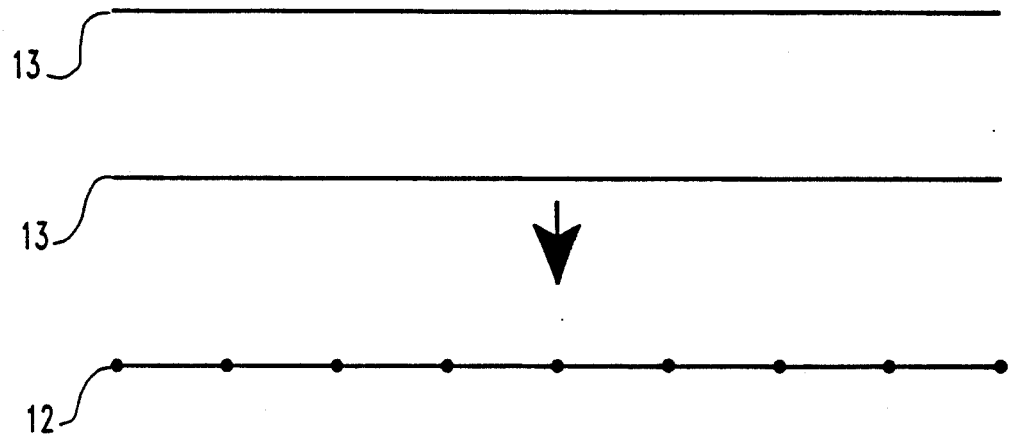
FIG. 1A is a schematic representation of the antenna elements of an array antenna receiving a signal in unison.
Figure 1B:
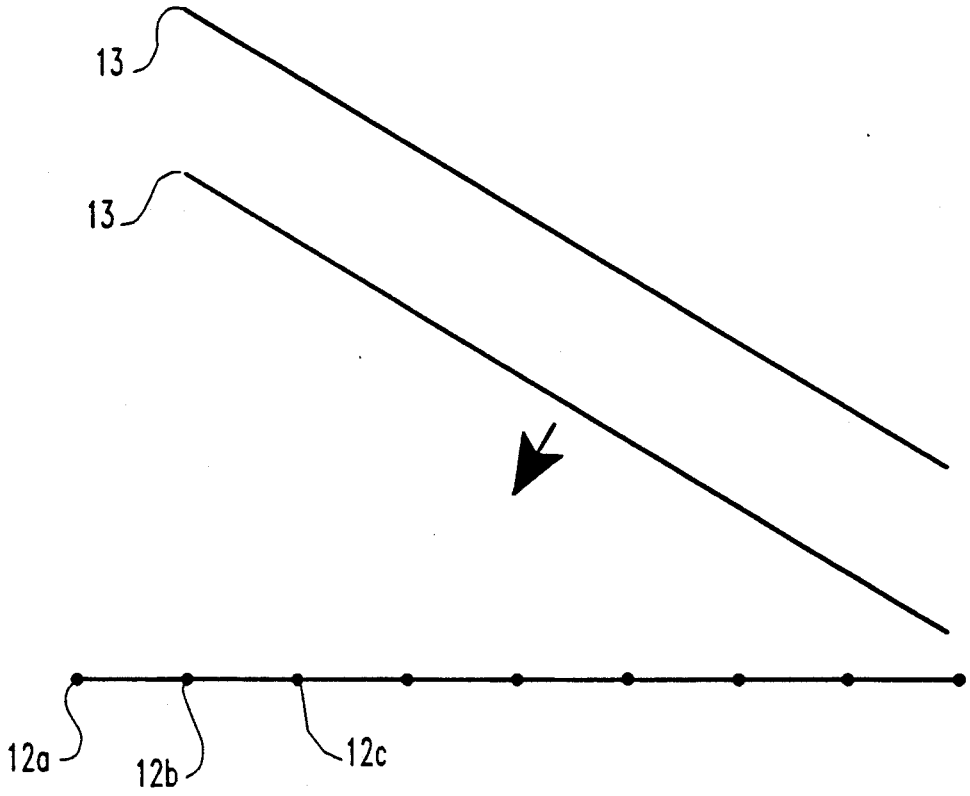
FIG. 1B is a schematic representation of the antenna elements of an array antenna receiving a signal with time delay.

Referring first to FIGS. 1A and 1B, a series of antenna elements 12 are shown receiving signals. In FIG. 1A, the signal at each of the antenna elements 12 arrives in unison to form a coincident signal at the antenna. No steering of the antenna from broadside is necessary as the signal is directed at the elements 12 in a direction that is perpendicular to the plane in which the antenna elements 12 reside. A signal beam (which is essentially a vector representing the direction of the most intense radiation, designated as an arrow in FIGS. 1A and 1B) is directed perpendicular to the wavefront 13. Therefore, when the signal is received at the antenna elements 12 in unison without steering, the beam is directed in the boresight direction.

Referring next to FIG. 1B, when the signals are not received at the antenna elements 12 in unison but are received in a time varied fashion along the array, the beam is directed at some angle from perpendicular to the plane in which the elements 12 reside. Thus, the beam in FIG. 1B is directed at some angle from boresight. By controlling the amount of time delay from when each element 12 receives the signal to when the signals are processed, the array antenna may be steered. For example, if the end element **12*a* is taken as a reference to steer the antenna to the right, the element 12*b* next to the end element 12*a* will have to be delayed by a time t and the next adjacent element 12*c* to be delayed by a time $2t$ (or $t_2$ if the elements are not equally spaced) and so on. To steer the antenna to the left, the element 12b next to the end element 12a should be advanced by a time t and the element 12c next to that by a time $2t$ (or $t_2$) and so on. Larger steering angles require larger values of t. The preferred manner to effectuate the time delay at each element 12 is by introducing the signals received at the elements as optic signals through a number of fiber optic transmission paths 32 in which the lengths of the paths 32** are varied according to the steering direction desired. The fiber optics may be fabricated of either glass or plastic. Glass may be used when higher precision is required, whereas plastic is a relatively inexpensive alternative when less precision is required.

Figure 2:
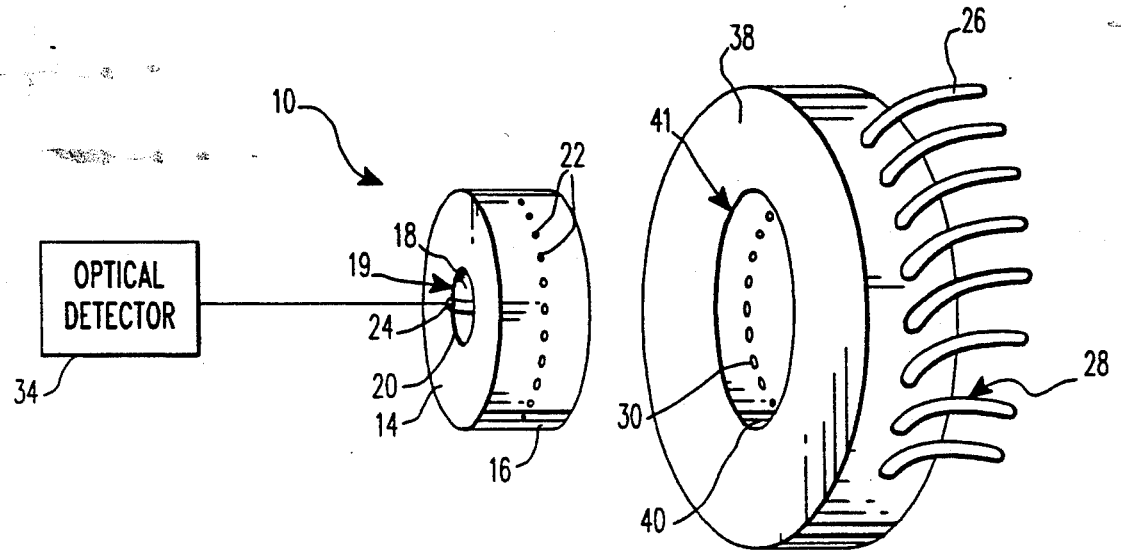
FIG. 2 is an exploded perspective view of a first preferred optical commutator.

Referring next to FIG. 2, a first preferred embodiment of an optical commutator 10 is shown. A moving element, preferably a rotor 14, is provided that is rotatable about a center axis. The rotor 14 has a cylindrical inner surface 18 and a coaxial cylindrical outer surface 16. The rotor inner surface 18 borders and defines a cylindrical cavity 19. A plurality of optical fibers 20 are disposed within the rotor 14 with a portion of each rotor fiber 20 extending partially out of the rotor inner surface 18. Each rotor fiber 20 has a first end 22 and a second end 24. Although the movable element is preferably a rotor 14, it is understood that the set of optical fibers 20 housed in the rotor 14 may be housed in any movable element such as a carriage that moves linearly.

Each rotor fiber first end 22 terminates along the periphery of the rotor outer surface 16. The rotor fiber first ends 22 are spaced apart circumferentially on the outer surface 16, preferably by a constant distance. Each rotor fiber 20 has a selected length so that the set of rotor fibers collectively have a selected distribution of lengths. The length distribution of the rotor fibers is based upon the configuration of the antenna elements. Mathematical algorithms may be employed to assist in arriving at the fiber length distribution.

Each rotor fiber second end 24 preferably extends out of the rotor inner surface 18, and terminates at an area located near the center of the rotor cavity 19. Each of the rotor fiber second ends 24 are directed in the same direction with respect to one another. The rotor fiber second ends 24 are preferably directed in a direction parallel to the axis of rotation of the rotor 14. As an alternative of this embodiment, the rotor need not have a rotor cavity 14, but may be cylindrically shaped. In this alternative, the rotor fiber second ends 24 would extend out of the area of the rotor near its center in a direction parallel to the axis of rotation of the rotor 14.

An optical detector 34 is positioned so as to receive the optical output directed from the center of the rotor cavity 19, transmitted from the the rotor fiber second ends 24. Devices capable of providing high intensity, amplitude modulated optical energy are required to deliver the optical signal to the optical commutator. Laser diodes are preferred because such units are available with relatively fast rise and fall times and are also capable of operation up to many GHz.

The first preferred optical commutator further has a stator 38 that has a cylindrical cavity 41 disposed centrally therethrough. The stator 38 has a plurality of input optical fibers 26 disposed therein. Each input fiber 26 has a selected length so that the set of input fibers collectively have a selected distribution of lengths. The distribution of input fiber lengths is based upon the configuration of the antenna elements. Mathematical algorithms may be employed to assist in arriving at the fiber length distribution. The input fibers 26 further have a first end 28 and a second end 30. The second end 30 of each input fiber 26 terminates along the periphery of the stator inner surface 40 so as to be circumferentially spaced. The input fiber second ends 30 are thus alignable with the first ends 22 of the rotor fibers 20.

Figure 3A:
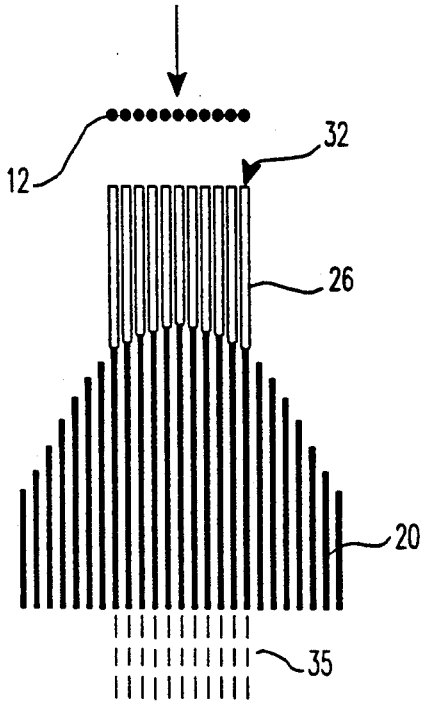
FIG. 3A is a representation of the alignment of the rotor fibers and the input fibers at the boresight setting for a linear antenna array.
Figure 3B:
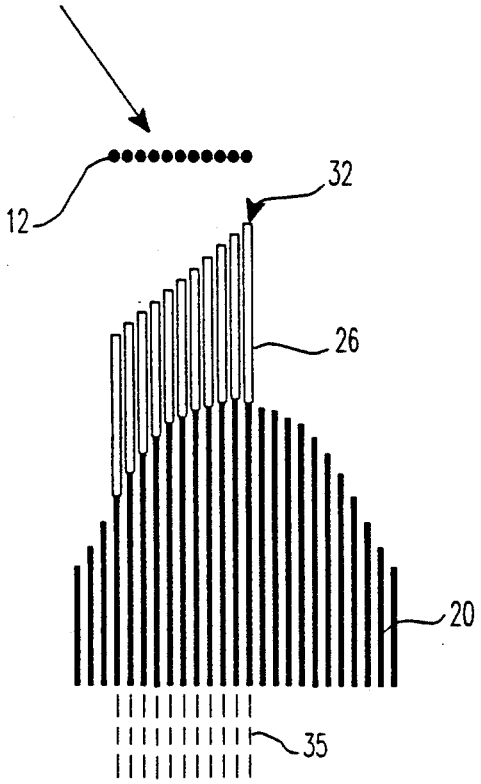
FIG. 3B is a representation of the alignment of the rotor fibers and the input fibers in a steer right setting for a linear antenna array.
Figure 3C:
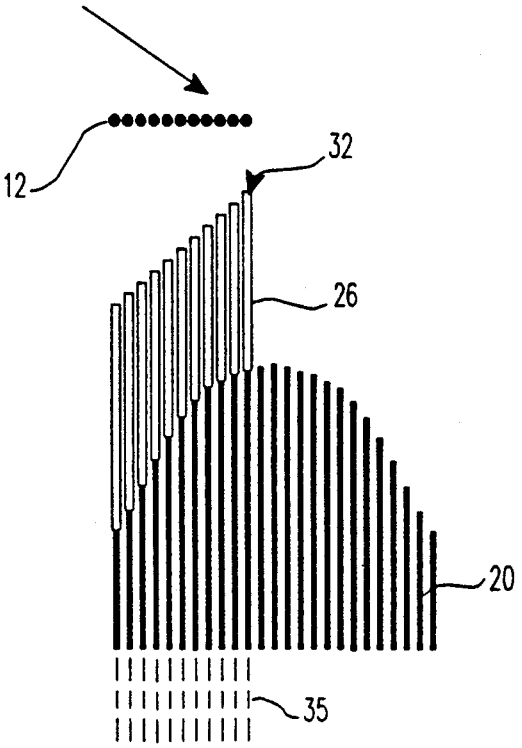
FIG. 3C is a representation of the alignment of the rotor fibers and the input fibers in a steer far right setting for a linear antenna array.

Referring next to FIGS. 2, 3A, 3B and 3C, selected optical delay line paths 32 for flat arrays are created by the selective alignment of the rotor fibers 20 with selected input fibers 26. In the flat array case, there are more rotor fibers 20 than there are input fibers 26. Thus, regardless of the rotor position, only some of the rotor fibers 20 are aligned with the input fibers 26. In FIGS. 3A, 3B and 3C, the alignments of the rotor fibers 20 and the input fibers 26 are shown through various beam positions for a linear array. As can be seen in the figures, for a linear array the distribution of lengths of adjacent rotor fibers 20 is preferably parabolic. As can be seen best in FIG. 3A, the relative lengths of adjacent input fibers 26 are also parabolic. It should be recognized that although the rotor fibers 20 and input fibers 26 are represented in the figures as being straight, the fibers are preferably coiled. Coiling the rotor fibers 20 allows one to use fibers of different lengths. The lengths of the rotor fibers 20 and the input fibers 26 are designed so that when selected rotor fibers 20 are aligned with the input fibers 26, the delay paths 32 formed by the combined fiber lengths are equal, thus having a linear distribution with a slope of zero, as seen in FIG. 3A.

As the rotor 14 is rotated causing the input fibers 26 to be aligned with different rotor fibers 20, the delay paths 32 have a perfectly linear but variable distribution. Thus, in the position seen in FIG. 3B, the delay path length distribution remains linear, but now having a slope. As the rotor 14 is continued to be rotated, as represented by FIG. 3C, the input fibers 26 align with still different rotor fibers 20. Again, the length distribution in the delay paths 32 is linear but with a slope different than the slope of the distribution of delay path lengths in FIG. 3B. Thus, regardless of the position of the rotor fibers 20 with respect to the input fibers 26, a linear distribution of combined fiber lengths results. In other words, the tops of the fibers 26 of the diagrams of FIGS. 3A, 3B and 3C always form a straight line.

In each of FIGS. 3A, 3B and 3C, antenna elements are placed at locations representing the delay path from the respective element. The amount of time delay of the signal received at each antenna element 12 is determined by the length of the delay path 32. The longer the delay path 32, the longer the time for the signal to reach the signal processing from each antenna element 12. In FIG. 3A, a signal that is directed as designed by the arrow arrives at each antenna element 12 simultaneously will be received at the signal processing at the same time, since each delay path 32 is equal in length. Thus, when the rotor is positioned to form the delay paths of FIG. 3A, the antenna is "steered" toward a signal traveling in the direction of the arrow. But in FIGS. 3B and 3C, the signals received at the antenna elements 12 having the shortest delay path 32 will be delayed the least, while the signals received antenna elements 12 having the longest delay paths 32 will be delayed the most. Therefore, when the rotor is positioned to form the delay paths of FIGS. 3B and 3C, the antenna is "steered" toward a signal traveling in the direction of the respective arrows. In this way, the angle by which the antenna is steered by the time delay of the optical commutator can be calculated by the slope of the length distribution of the delay line paths 32.

The rotor is caused to rotate by any convenient means such as having a motor-driven shaft (not shown) connected to it. Preferably, the electrical components of a motor (not shown) are integrated into the rotor and stator. With the optical commutator capable of being its own motor, the commutator may be sealed, evacuated reducing friction in the system and reducing the possibility of contaminating the optical surfaces. A magnetic bearing may be employed, eliminating the possibility of any wear in the elements.

The performance requirements of a radar or communication system determines the beamwidth to be attained by the antenna array. The higher the required resolution of the antenna, the more narrow will be the beamwidth, and the greater will be the number of antenna elements 12. The beamwidth for a flat array (linear or planar array) is related to the number (n) of elements 12 in a row, with the spacing of one half wavelength, by the formula:

$$n=102/\phi_b$$

whereas $\phi_b$ is the half power beamwidth. Since each element 12 is connected to an input fiber 26, n also represents the number of input fibers 26.

As each element 12 requires a separate timing control, the value of n is also the number of input fibers 26 to be utilized in the optical commutator. A further consideration in the design of the optical commutator is the arc over which the array must scan. If this arc is defined as plus and minus $\phi_m$ from the boresight, the number of usable positions or settings (particular alignments of the rotor fibers 20 with the input fibers 26) will be given by the formula:

$$N=2\phi_m/\phi_i$$

where $\phi_i$ is the incremental indexing angle of the rotor 14. In practice, $\phi_i$ must be at least as small as $\phi_b$ to achieve full field coverage. Setting $\phi_i$ equal to $\phi_b$ gives the minimum value of N:

$$N=2\phi_m/\phi_b$$

The number (m) of rotor fibers 20 of the optical commutator may be calculated using this value of N and by knowing the number of input fibers n, by the following relationship:

$$m=N+n$$

Once the scanning arc and the resolution have been defined, the number of rotor fibers 20 can be established from the above equations. The number of rotor fibers 20 is directly proportional to the system angular resolution. It should be noted that in a flat antenna array, not all of the possible rotor positions can be used. As the rotor 14 is rotated and the input fibers 26 begin to align with some of the rotor fibers 26 designated as the extreme right of FIGS. 3A through 3C and some of the rotor fibers 20 designated as the extreme left of FIGS. 3A through 3C, some settings will not be usable. These settings are referred to as flyback settings. The fraction of total rotor positions that are usable is given by the formula:

$$\text{usable/total}=(m-n)/m$$

where m is the number of rotor fibers 20 and n is the number of input fibers 26.

When the rotor 14 of the optical commutator is turned, the input fibers 26 align with the successive groups of rotor fibers 20 to obtain the necessary timing to steer the flat antenna array. A feature of the parabolic distribution of lengths for the commutator fibers is that the rate of change of the delay path lengths is proportional to the rotor 14 displacement from boresight. This results in a specific relationship between the angle through which the rotor 14 turns and the angle through which the antenna is steered. This relationship is almost linear so that a given amount of rotation of the rotor 14 will result in a corresponding rotation of the direction of antenna steering. The magnitude of the rotation of the direction of antenna steering will depend on the "gear ratio" which in turn depends on the particular design of the commutator. The gear ratio is defined as the ratio of the angular change of the rotor to the angular change in the antenna steering direction. A rotor or "shaft" rotation of $\phi_s$ will result in an antenna steering of $\phi_b$ which is equal to G $\phi_s$, where G is the gear ratio. The rotor fibers 20 have a parabolic distribution and are arranged with an angular pitch of P. If the total number of rotor fibers 20 is m, the angular pitch (P) in radians will be given by:

$$P=2\pi/m$$

By rotating the rotor by P, the input fibers 26 will be moved from alignment with one setting of the rotor fibers 20 to the next, which results in the antenna being indexed to the next antenna steering setting. The number of settings through which the antenna is indexed will depend on the beamwidth and the maximum angle (plus and minus $\phi_m$ from the boresight) over which the antenna is steered. A full rotation of the rotor 14 will rotate the antenna steering direction through 2 $\phi_m$ and through the flyback settings. The portion of the rotor rotation taken up with the flyback settings depends on the number of rotor fibers 20 and input fibers 26 and is calculated by:

$$F=2\pi n/m$$

The usable rotation of the rotor 14 is given by:

$$R=2\pi(m-n)/m$$

The gear ratio is then found by:

$$G=R/2\phi_m=(\pi/\phi_m)\,(m-n)/m$$

Figure 4:
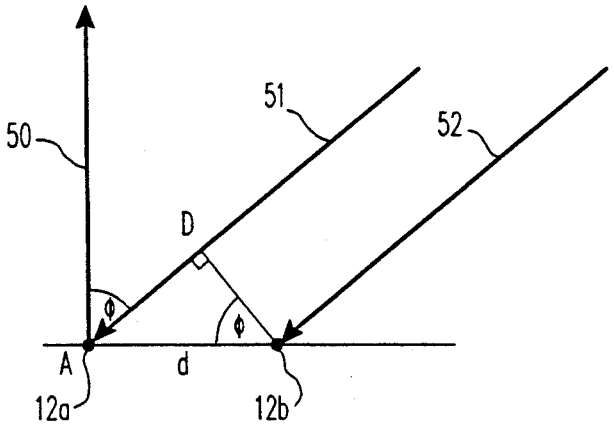
FIG. 4 is a schematic representation of the direction of antenna steering from adjacent antenna elements.

Once the system requirements have established the arc over which the antenna must be steered and the magnitude of the angular intervals the antenna steering is to be stepped, the lengths of the rotor fibers 20 and input fibers 26 may be calculated. FIG. 4 illustrates antenna elements **12*a* and 12*b* which are spaced by distance d. Each element receives a signal indicated by arrows 51 and 52. If the antenna is to be steered at an angle $\phi$ from the boresight 50, a signal 52 received at element 12*b* must be delayed more than the signal received at element 12*a* by the time it takes the signal 51 to travel the distance between reference point D and element 12a** (referred to as distance AD). Distance AD is given by:

$$AD = d \sin \phi$$

where d is the element spacing. The delay needed for element 12b must be more than that of element 12a by a time t given by:

$$t = d \sin \phi / c$$

where c is the speed of light in free space. The speed of light is slower in the fiber optic delay lines by the factor $\mu$, the refractive index of the fiber optical material. The difference in lengths of the delay path 32 for element 12a and the delay path 32 for element 12b is given by:

$$\Delta L = d \sin \phi / \mu$$

If the maximum angle to be steered is $\phi_m$, the maximum fiber optic length difference $\Delta L$ will be:

$$\Delta L = d \sin \phi_m / \mu$$

The length of a rotor fiber 20 may be expressed by the equation:

$$L_n = L_0 - an^2$$

where n is the rotor fiber position counted from the center of symmetry of the rotor winding distribution, $L_0$ is the length of the fiber in the center of symmetry position, $L_n$ is the length of the rotor fiber n positions away from the center of symmetry and a is the parabolic constant that defines the scale of the parabolic distribution of rotor fibers (determined by the system requirements). The above equation for $L_n$ may be stated, through mathematical substitutions, by the following formula:

$$L_n = L_0 - n^2(d/\mu) \sin \phi_m / (2\phi_m/\phi_i - 1)$$

The rotor fibers 20 are wound within the rotor 14 in any convenient manner. However, each fiber optic end preferably is directed directly towards its coupled optical transmission line. Therefore, the rotor fiber first ends 24 preferably intersect the rotor outer surface 16° at a 90° angle. Additionally, care must be taken so that the bending radius of any point on the rotor fiber 20 does not become too small. If the bending radius on fiber optics is too small, excessive light loss will occur.

Similarly, it can be shown that the length of the input fibers in the nth position from the center of symmetry of the input fiber distribution is given by:

$$L_n = L_s + n^2(d/\mu) \sin \phi_m / (2\phi_m/\phi_i - 1)$$

where $L_s$ is the length of the input fiber 26 at the center of symmetry of the input fiber distribution.

The optical commutator may also be employed in a circular array of antenna elements 12. The principal of the commutator is the same for the circular array as for the flat array, however, different rotor fiber and input fiber distributions are used. Additionally, there are more input fibers than rotor fibers in the circular array. Therefore, regardless of the rotor position, the rotor fibers are aligned with only some of the input fibers.

Figure 5:
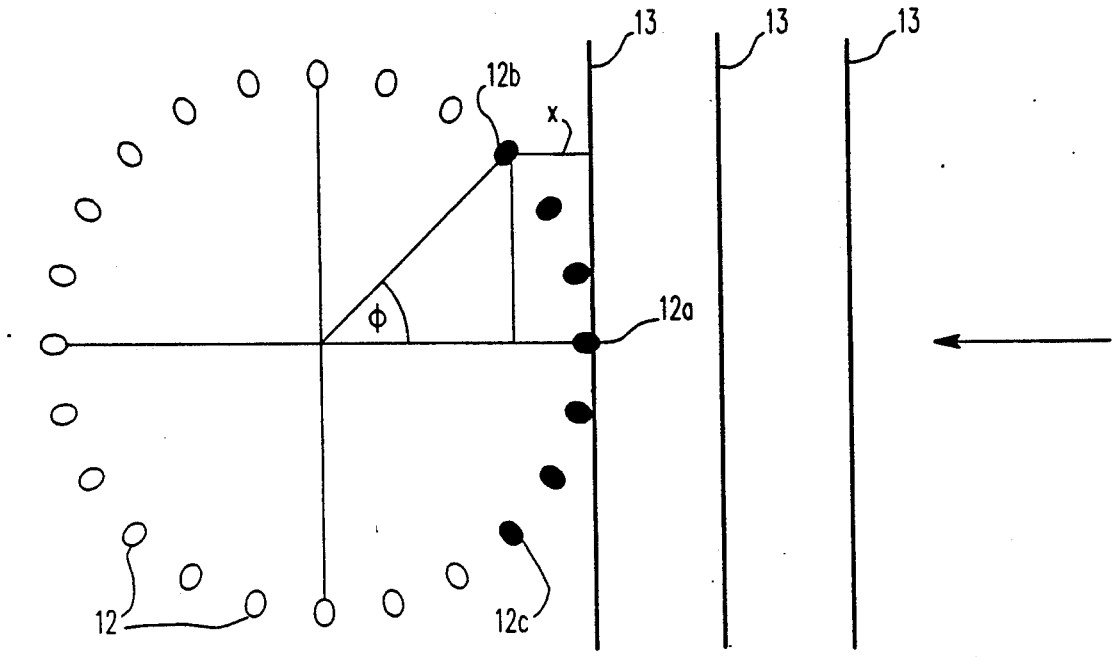
FIG. 5 is a schematic representation of a circular antenna array.
Figure 6:
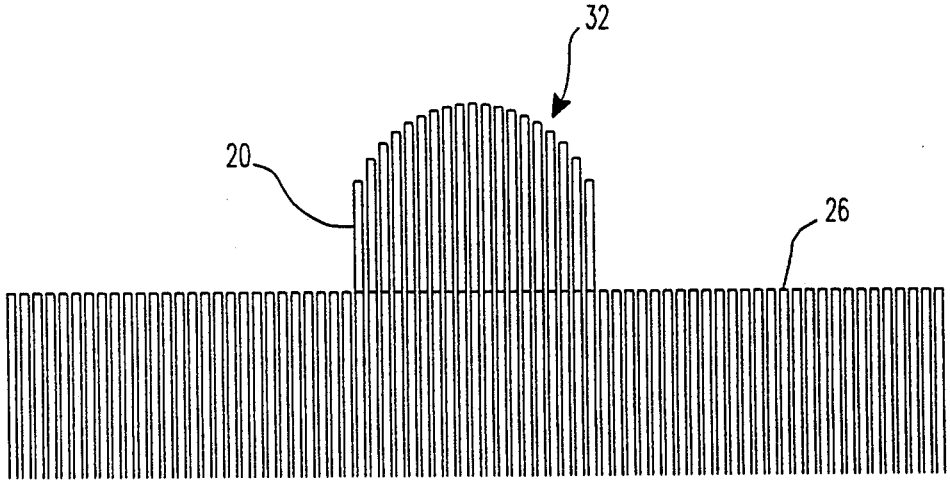
FIG. 6 is a representation of the alignment of the rotor fibers and the input fibers for a circular array.

The beam is steered in this array configuration as best seen in FIGS. 5 and 6. The antenna elements 12 are arranged in a circle. For the wavefronts 13 of FIG. 5 (moving in the direction indicated by the arrow) to be formed, the signal received at antenna element 12a must be delayed a selected amount. The signal at elements 12b and 12c must be delayed a less amount. The antenna elements between element 12a and 12b and between element 12a and 12c must be delayed a progressively lesser amount from 12a to 12b and 12c, respectively. The delay path lengths can be seen best in FIG. 6. The input fibers are each of the same length, and the rotor fibers have a cosine-shaped length distribution. Thus, the delay path length distribution is cosine-shaped.

The advance in time of the signals received at elements 12b and 12c over that of element 12a is the same time that it takes the radiation to travel distance x (the distance from elements 12b and 12c to the wavefront tangent line). The time to travel distance x is given by the equation:

$$t_n = x/c = R(1 - \cos n_o\phi)/c$$

where c is the velocity of light and $n_o$ is the element number counted from the boresight axis. To produce the wavefront 13 the nth element must lead in time by $t_n$ or the center element 12a must be delayed by time $t_n$ over the nth element. The length of each delay path 32 dictates the amount of time delay imparted on the signal received at each antenna element 12. The optical delay line path 32 feeding the center element 12a must be longer than the delay line path 32 of the $n_o$ element by distance y given by:

$$y = R(1 - \cos n_o\phi)/\mu$$

where $\mu$ is the refractive index of the fiber optic.

Figure 7:
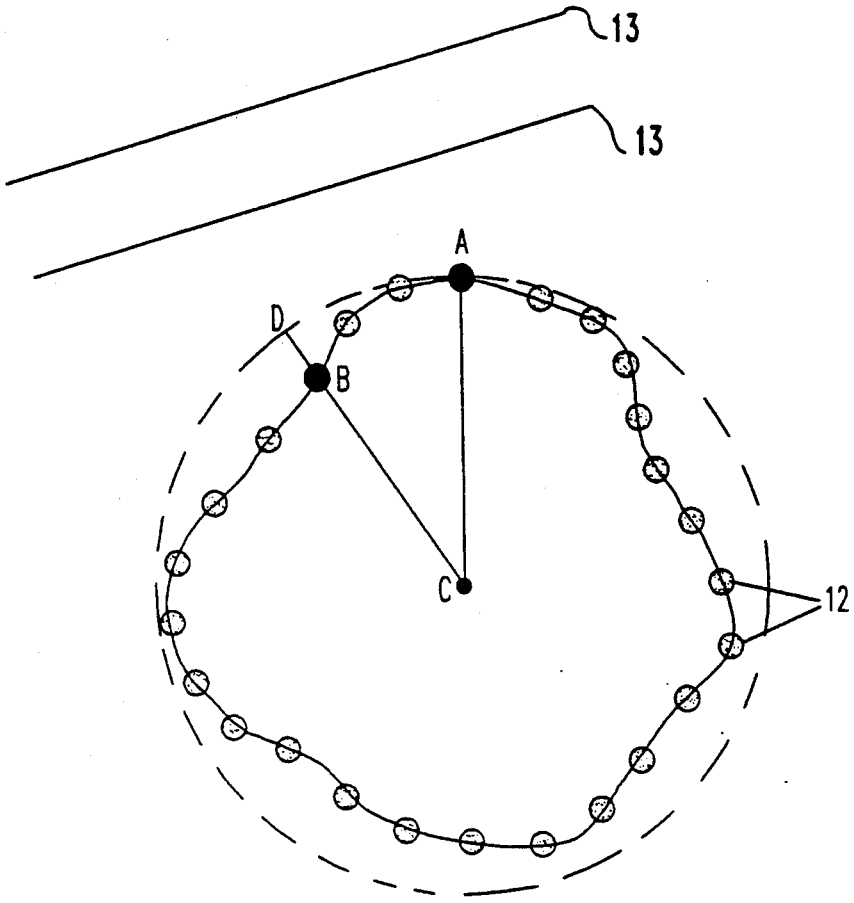
FIG. 7 is a schematic representation of an irregular antenna array.

Referring to FIG. 7 a conformal array is shown. These conformal or irregular arrays are treated as a type of circular array. The irregular array can be converted to the circular equivalent discussed above by adjusting the lengths of the input fibers. A reference circle shown in dotted line can be drawn around the conformal antenna array as shown. A point C within the circle can be selected as a reference point. From this point, the delay timing can be measured. Consider two antenna elements A and B connected to point C by straight fibers. Point A is located on the reference circle and hence can be considered a reference point. Now consider the case in which the array is to be steered toward incoming wavefront 13. The signal from the wavefront 13 will arrive at points A and D simultaneously. However, electromagnetic signals propagate more quickly through free space than through optical fibers. Therefore, the signal travelling by path BC to point C will arrive sooner than the signal travelling path AC to point C. Thus, the signal received by element B must be further delayed relative to element A. This is accomplished by adjusting the lengths of the fibers feeding elements A and B. Therefore, the length of optical fiber connected to element B may be increased, or conversely, the length of optical fiber connected to element A may be decreased to provide the desired delay. The additional length of fiber is computed by the equation $DB(\mu - 1)/\mu$. The remaining elements are likewise provided with respective delays thereby fashioning an antenna that may operate as a circular array despite being configured as an irregular array. In this manner, any odd shaped array can be converted to the circular equivalent by adjusting the input fiber lengths connected to the antenna elements. The rotor fiber lengths will remain the same as that for the circular array case.

Figure 8:
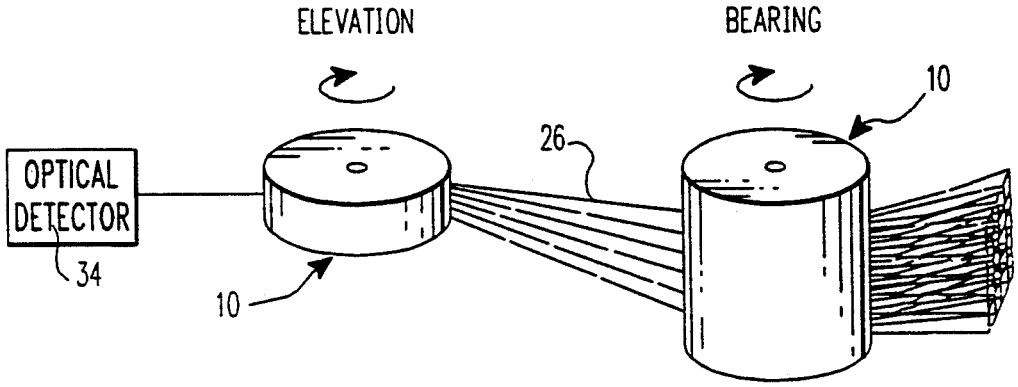
FIG. 8 is a schematic representation of two dimensional antenna steering using two optical commutators.

Referring to FIG. 8, two dimensional steering can be accomplished by employing two optical commutators in series. One commutator provides the elevation steering and the other commutator provides the bearing steering. The first commutator provides a selected number of outputs, each of which feed the second commutator providing a selected number of inputs for each feed. Thus, a planar or cylindrical array can be constructed by utilizing a linear or circular array commutator, respectively, as one of two commutators used in series.

The rotor 14 can be caused to rotate by any convenient means but preferably has conventional and known motor components such as electrical windings incorporated on the rotor and the stator. Alternatively, the rotor may be mounted on a shaft with the shaft being coupled to a motor.

Figure 9:
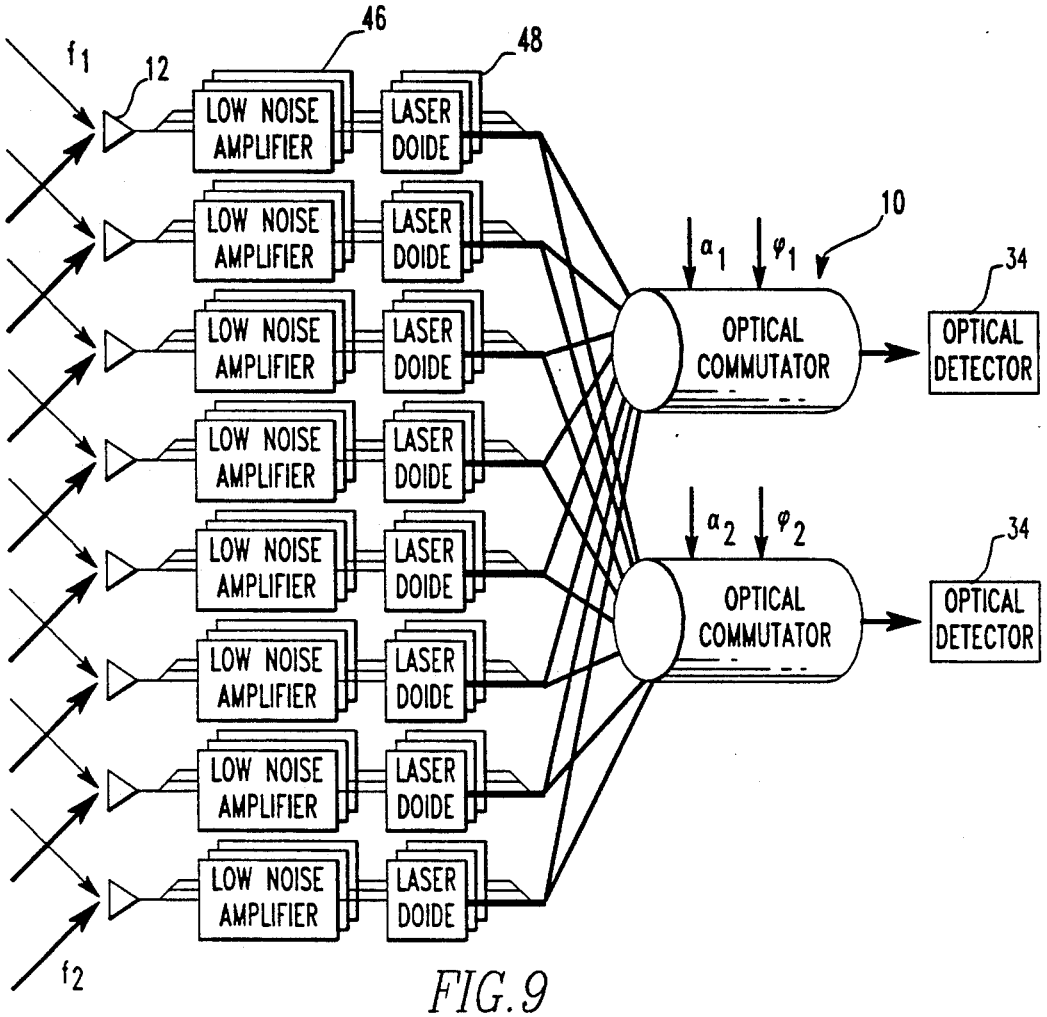
FIG. 9 is a block diagram of a receiving array steered by the optical commutator.

Referring next to FIGS. 2 and 9, the second end 24 of the rotor fibers 20 are connectable to an optical detector 34. The optical detector 34 converts the optical signals to electrical signals. A variety of optical detectors are known in the art. Such devices are commonly fabricated from either silicon, germanium or indium-gallium arsinide. The choice of material is dictated by the wavelength of the light to be detected. Light having wavelengths in the 1300 nanometer range cannot be detected by the silicon devices because the photon quantum energy is insufficient to generate hole-electron pairs. Although several different types of optical detector devices are known, the pin diode type is the preferred optical detector type because they have a relatively high frequency capability. It is understood that the operation of converting light signals from the rotor fibers to electrical signals may be performed in several alternative ways in the optical detector 34. For example, each of the light signals from respective rotor fibers may be converted to electrical signals in the optical detector 34, with the electrical signals then being summed to produce a single value of the electrical signal. Alternatively, the light signals from the respective rotor fibers may be combined into a single light signal such as by directing the light signals through a network of converging optical fibers (not shown), with the combined light signal then being converted to an electrical signal. Also, the converging network of optical fibers may be located within the optical detector 34, may be located exterior to the optical detector 34, or may be housed in a separate unit.

Each element 12 is connected to a means for converting RF signals to optical signals. The preferred means of converting RF signals to optical signals for each antenna is a low noise amplifier in series with a laser diode. The output of each low noise amplifier is fed to a laser diode that converts the electrical signal to an optical signal. The emission from the laser diodes will be a light beam, being amplitude modulated at the frequencies being received. The optical signals may then be fed to a selected number of optical commutators by means of multifercated light pipes. The optical signal outputs from the laser diodes 48 are input to the optical commutator at the first ends of the input fibers.

Figure 10:
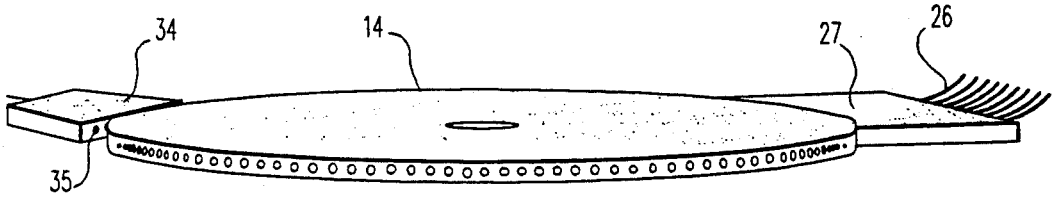
FIG. 10 is a perspective view of a second preferred optical commutator.

Referring next to FIG. 10, a second preferred embodiment of the optical commutator is shown. The optical commutator of this embodiment employs a cylindrical rotor 14 as the movable element. The rotor 14 has a plurality of optical fibers 20 provided therein. The rotor 14 has a cylindrical outer surface 16. Each rotor fiber 20 has a selected length. The rotor fibers 20 further have a first end 22 and a second end 24 that terminate along the outer surface 16 of the rotor 14. It is desirable for the efficient transmission of light for the first and second ends of the rotor fibers 22, 24 to align with the input fibers 26 and optical detector 34, respectively. The rotor fiber first and second ends 22, 24 are circumferentially spaced on the rotor outer surface 16 at a constant angle.

The second preferred optical commutator also has an optical detector 34 located at the rotor outer surface 16 for converting the optical output from the second end 22 of selected rotor fibers 20 to electrical signals. Preferably, a pin diode converts the optical signals to electrical signals. It is understood that the optical detector 34 is a device or group of devices for converting the optical signals obtained from the rotor fibers to a single electrical signal. Therefore, optical detector 34 may have one or a plurality of pin diodes or other conversion means, each receiving an optical signal from respective rotor fibers and converting them to individual electrical signals. The electrical signals would then be combined to obtain the single electrical signal. Alternatively, optical detector 34 may have a converging network of optical fibers that produce a single optical signal from the several optical signals received from the rotor fibers. The single optical signal would then be converted to a single electrical signal in a pin diode or other conversion means.

A plurality of input optical fibers 26 are provided, each having a selected length and having a first end 28 and a second end 30. The first end 22 of selected rotor fibers 20 are alignable with the second end 30 of the input fibers 26. The first ends 28 of the input fibers 26 are connectable to respective antenna elements 12. As the rotor 14 is rotated, selected rotor fibers 20 are aligned with the input fibers 26. The input fibers 26 may be housed in a housing 27 that is circumferentially spaced at a constant radial angle from the optical detector 34. Or, both the input fibers 26 and optical detector 34 may be housed in a stator similar to the stator of the first preferred embodiment.

Aside from both the first 22 and second 24 ends of the rotor fibers 20 terminating along the outer surface 16 of the rotor 14 and having the optical detector 34 being provided at the rotor outer surface 16, the second preferred embodiment of the optical commutator functions identically to the first preferred embodiment. Therefore, the length distributions of the rotor fibers and the input fibers are preferably provided as discussed above for the flat array of the first preferred embodiment.

To this point of the description of the second preferred embodiment, a first end 22 and a second end 24 of the rotor fibers 20 has been described. However, it is understood that optical signals may be transmitted in either direction within the rotor fibers 20. Therefore, whichever end of each rotor fiber 20 is aligned with an input fiber 26 is considered the rotor fiber first end 22. Similarly, whichever end of each rotor fiber 20 is aligned with the optical detector 34 is considered the rotor fiber second end 24. Thus, after a complete rotation of the rotor 14 has occurred, a given end of any rotor fiber 20 may be aligned with both the optical detector 34 and the input fibers 26.

The optical detector 34 may be coupled directly to the rotor fiber second ends 24, or they may be connected to the rotor fiber second ends 24 by a set of intermediate optical fibers 35 (shown in dotted line in FIGS. 3A, 3B and 3C). In the case in which a set of intermediate optical fibers 35 connects the rotor fibers to the optical detector 34, selected intermediate fibers 35 are alignable to selected rotor fiber second ends 24. The intermediate fibers 35 are preferably all of equal length as indicated in the Figures, however, fibers 35 may have a parabolic length distribution. When the intermediate fibers 35 have a parabolic length distribution, they would have a similar length distribution as is shown for the input fibers 26 in FIGS. 3A, 3B and 3C. In this case, the intermediate fibers 35 would cooperate with rotor fibers 20 to comprise the linear delay paths 32 shown in the Figures. In this case, the input fibers 26 would all be of the same length and would additionally form the delay paths 32.

Although one optical detector 34 and one set of input fibers 26 are shown and preferred, additional pairs of optical detectors 34 and sets of input fibers 26 may be used. These additional pairs of optical detectors 34 and sets of input fibers 26 allow more than one beam to be steered from the same antenna array using only one optical commutator.

For either embodiment, the rotor 14 preferably indexes to a specific angle of steering, dwells, and then indexes to a new angle of steering. However, the rotor 14 may instead rotate continuously. Also, the rotor 14 may rotate through a given steering position, dwell, and then reverse direction of rotation so as to oscillate.

The optical signal is preferably generated as a pulsed laser beam, however, the laser input may be continuous. By coordinating the frequency of the pulse with the rotation of the rotor 14, antenna steering may be accomplished. For example, if the laser is pulsed at the same rate that the rotor is rotated, the same rotor fibers 20 will receive the optical input, and the antenna will be steered in a fixed direction. To steer the antenna, the laser input can be pulsed at a greater or lower repetitive rate as compared with the rotational rate of the rotor. Similarly, the pulse rate of the laser may remain fixed while the rotational rate of the rotor is varied.

It should be noted that if the laser input is continuous, the dwell time, that is the time period during which the light can pass unimpeded through the commutator, will be a fraction of the time in which energy is supplied. This is because light may only be transmitted when the rotor fiber and input fiber are in at least partial alignment. Of course, the transmission of the light is most efficient when the rotor fibers and input fibers are exactly aligned.

Additionally, there are limitations as to the length of the laser pulse. If the pulse is too long, the rotor fibers and input fibers will begin to move out of alignment during the pulse and the efficiency of the transfer will be reduced. Efficiency of the light signal transfer can be increased by making the diameters of the input fibers larger than the diameters of the rotor fibers.

Figure 11:
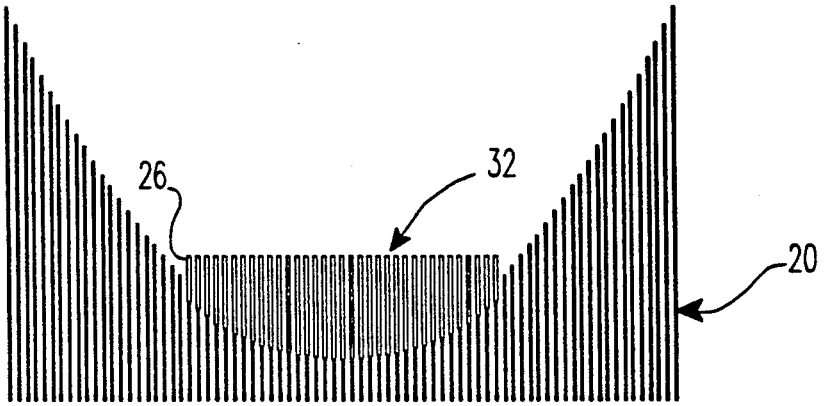
FIG. 11 is a representation of an alternative delay path configuration for the optical commutator in a linear array.

Variations of the preferred embodiments can be made. For example, the preferred length distributions of the rotor fibers and the input fibers are parabolic, with the input fibers being convex and the rotor fibers being matingly concave as seen in FIGS. 3A through 3C. However, as shown in FIG. 11, the input fibers may have a concave parabolic length distribution while the rotor fibers are matingly convex.

Also, although the preferred element for housing the set of optical fibers 20 is a rotor 14, the fiber may be housed in any movable element. For example, the fibers 20 may be housed in a carriage that slides of moves linearly relative to the input fibers. The operation of the commutator would otherwise be similar to the rotor embodiment.

In addition, the ends of the rotor fibers are preferably circumferentially spaced at some distance from one another along the rotor outer surface. However, the circumferential spacing between rotor fiber ends may be reduced to virtually no distance, creating an effective continuum of fiber optics.

Figure 12:
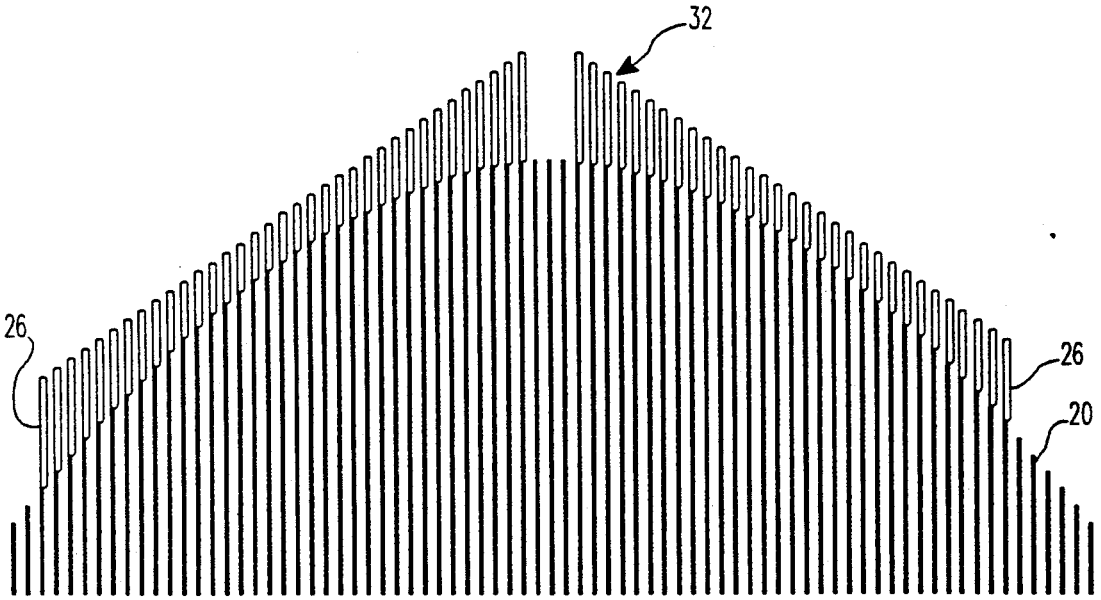
FIG. 12 is a representation of the alignment of two sets of rotor fibers with the input fibers in a linear array.

Additionally, although only one set of input fibers is utilized in the preferred embodiments, two or more sets of input fibers may be employed as shown in FIG. 12. Multiple sets of input fibers can be particularly advantageous where higher pulse repetition frequencies are desired. Furthermore, in the flat antenna array application, multiple poles can be employed to provide valid steering positions from one set of fibers while another set of fibers are on a flyback setting.

Similarly, multiple sets of rotor fibers may be employed in a single rotor. If the first and second ends of the rotor fibers do not lie at 180° from one another along the rotor periphery, as is preferred, but rather lie at some lesser angle, then more than one set of rotor fibers may be placed in the rotor.

While certain present preferred embodiments have been shown and described, it is distinctly understood that the invention is not limited thereto but may be otherwise embodied within the scope of the following claims.

I claim:

1. A device for delaying signals received at antenna elements of an array antenna, the device providing signal delay paths of selectable length between respective antenna elements and signal processing means, the device comprising:

(a) a set of first fiber optic lines having selected lengths;

(b) a set of second fiber optic lines, each second fiber optic line having a selected length and being alignable with a first fiber optic line; and (c) means for moving at least one of the first and second sets of optical fibers relative to the other of the first and second sets of fibers, wherein delay paths are formed comprised of respective aligned first and second fiber optic lines.

2. A device for delaying signals received at antenna elements of an array antenna, comprising:

(a) means connected to each antenna element for converting electrical signals received at the antenna elements to respective optical signals;

(b) a plurality of input optical fibers, each input fiber having a selected length, a first end of each input fiber being connected to the electrical to optical conversion means for receiving respective optical signals therefrom, and each input fiber further having a second end;

(c) a movable element having a plurality of fibers provided therein, each movable element fiber having a selected length and having a first end and a second end, each movable element fiber passing through a point on an outer surface of the movable element, the first end of selected movable element fibers being alignable with the second end of the input fibers, the aligned movable element fibers and input fibers comprising respective delay paths;

(d) an optical detector connectable to the movable element fiber second ends for converting the optical output from the movable element to an electrical signal; and (e) means for moving the movable element so that selected movable element fibers are aligned with the input fibers providing selected delay path length distributions.

3. The device of claim 2 wherein the movable element is configured as a cylindrical rotor, wherein the optical fibers of the rotor pass through a point on an outer circumference of the rotor, and wherein the means for moving the rotor cause the rotor to be rotated.

4. The device of claim 3, wherein the antenna elements are arranged in a linear array.

5. The device of claim 4, wherein the rotor fibers and input fibers have a parabolic length distribution, such that the delay paths have a linear length distribution, the linear delay path length distribution having a slope that varies with rotation of the rotor.

6. The device of claim 2 further comprising a set of intermediate optical fibers, each intermediate fiber having a selected length and being connected at one end to the optical detector and being connected at an opposite end to selected movable element fiber second ends, wherein the aligned intermediate fibers, movable element fibers and input fibers form respective delay paths.

7. The device of claim 6, wherein the movable element fibers and one of the set of intermediate fibers and the set of input fibers have a parabolic length distribution, such that the delay paths have a linear length distribution, the linear delay path length distribution having a slope that varies with movement of the moveable element.

8. The device of claim 2 wherein the electrical to optical conversion means is a plurality of low noise amplifiers, each amplifier being connected to a respective antenna element, and a plurality of laser diodes, each laser diode being connected to a respective amplifier.

9. The device of claim 3, wherein the antenna elements are arranged in a circular array.

10. The device of claim 9, wherein the input fibers have a linear length distribution and the rotor fibers have a cosine-shaped length distribution, such that the delay paths have a cosine-shaped length distribution.

11. The device of claim 3, wherein the rotor has a cylindrical outer surface, the rotor fiber first ends and the rotor fiber second ends terminating along the outer surface of the rotor such that the fiber ends are circumferentially spaced on the rotor outer surface.

12. The device of claim 11, further comprising a stator that is coaxial to and surrounds the rotor, wherein at least one of the optical detector and the input fibers are housed in the stator.

13. The device of claim 11, further comprising at least one additional optical detector and one additional set of input fibers, each being alignable with the rotor fibers.

14. The device of claim 11, wherein the optical detector is located adjacent to the outer surface of the rotor.

15. The device of claim 3, wherein the rotor has an outer cylindrical surface, the rotor fiber second ends terminating at a center area of the rotor, each rotor fiber first end terminating along the periphery of the rotor outer surface such that the rotor fiber first ends are circumferentially spaced on the outer surface periphery.

16. The device of claim 15, wherein the optical detector is positioned so as to receive optical signals that have emitted from the center area of the rotor.

17. The device of claim 15, wherein the rotor further has an inner cylindrical surface coaxial to the outer cylindrical surface, the inner surface bordering and defining a cylindrical cavity.

18. The device of claim 15, wherein the input fibers are housed in a stator having a cylindrical inner surface that borders and defines a cylindrical cavity, wherein the rotor is disposed coaxially within the stator cavity, and the input fiber second ends terminating circumferentially along the periphery of the stator inner surface.

19. The device of claim 3, wherein the antenna elements are arranged in an irregular array.

20. A method of selectively delaying signals received at respective antenna elements of a planar array, comprising the steps of:

(a) converting electrical signals received at the antenna elements to respective optical signals;

(b) providing a set of first optical fibers, wherein a selected number of first fibers receiving optical signals from respective antenna elements;

(c) providing a set of second optical fibers, wherein a selected number of second fibers are selectively alignable with and receiving optical signals from respective first fibers; and (d) moving at least one of the set of first fibers and set of second fibers so that selected first and second fibers are aligned.

* * * * *